US006447317B1

(12) United States Patent
Billman

(10) Patent No.: US 6,447,317 B1
(45) Date of Patent: Sep. 10, 2002

(54) BACKPLANE CONNECTOR

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/904,353

(22) Filed: Jul. 11, 2001

(51) Int. Cl.[7] ..... H01R 13/631
(52) U.S. Cl. ..... 439/260; 439/607; 439/108
(58) Field of Search ..... 439/260, 607–610, 439/108, 101, 65

(56) References Cited

U.S. PATENT DOCUMENTS 3,130,351 A * 4/1964 Giel
3,665,370 A * 5/1972 Hartman ..... 439/260
4,556,268 A * 12/1985 Noschese ..... 439/267
5,785,534 A * 7/1998 Longueville et al. ..... 439/65
5,823,823 A * 10/1998 Longueville et al. ..... 439/571
6,012,927 A * 1/2000 Longueville et al. ..... 439/65
6,206,713 B1 * 3/2001 Baertsoen et al. ..... 439/260

* cited by examiner

*Primary Examiner*—Gary F. Paumen
(74) *Attorney, Agent, or Firm*—Wei Te Chung

(57) ABSTRACT

An electrical connector (100) includes an insulative housing (10) having a slot (12), a row of low-speed signal contacts (18) and an insert module (16) received in respective opposite sides of the slot. The insert module has two rows of high-speed signal contact modules (40) confronting the row of low-speed signal contacts. The insert module is pivotable in the slot from a first position, where the connector is ready for receipt of a daughter board (70), to a second position, where the insert module and the row of low-speed contacts sandwich the daughter board therebetween. The electrical connector provides a pair of actuators (208) pivotably located at the top of the insulative housing. In the second position, the actuators abut against the back portion of the insert module to pivot toward the daughter board, thereby ensuring electrical connection between the high-speed contacts in the insert module and the solder pads on the daughter board.

1 Claim, 13 Drawing Sheets

BACKPLANE CONNECTOR

CROSS REFERENCE TO RELATED APPLICATIONS

This application is related to United States Patent Application Ser. No. 09/893,810 filed Jun. 27, 2001 and entitled "ELECTRICAL CONNECTOR WITH A SUPPORTING MECHANISM".

BACKGROUND OF THE INVENTION

1. Field of the Invention

The present invention relates to a connector, and particularly to an InfiniBand backplane connector mountable on a mother board and accommodating a daughter board therein, thereby establishing electrical connection between the mother board and the daughter board.

2. Description of the Related Art

Today's computing model is becoming more distributed as companies work to meet the growing demands of the Internet economy. The demands of the Internet and distributed computing are challenging the scalability, reliability, availability, and performance of servers. To meet this demand a balanced system architecture with equally good performance in the memory, processor, and input/output (I/O) subsystems is required. Seven of the computing industry's leaders, Compaq, Dell, Hewlett-Packard, IBM, Intel, Microsoft and Sun Microsystems have joined together to address this important issue by leading an independent industry body called the InfiniBand$^{SM}$ Trade Association. The association is dedicated to developing a new common I/O interconnect standard. In Oct. 24, 2000, the association released the version 1.0 of the InfiniBand Architecture Specification which disclosed a rudiment of an InfiniBand backplane connector in the chapter 10 thereof.

The disclosed InfiniBand backplane connector is a low insertion force connector with two sets of contacts. One set of contacts, accommodated in an insulative module, is used on the primary side of the InfiniBand board for high-speed differential pair signals and its corresponding grounds. A second set of contacts is used on the secondary side of the board for low-speed signals, power, and grounding. The 12X type connector contains 24 pairs of high-speed contacts (48 pins) and 18 low-speed/power contacts. Closure of the mechanism to engage the high-speed contacts is achieved by an internal mechanism which is actuated by outline features on a paddle guard. U.S. Pat. No. 6,206,713, assigned to Tyco, and U.S. Pat. Nos. 5,785,534, 5,823,823 and 6,012,927, assigned to Siemens, disclosed similar backplane connectors.

However, the disclosed InfiniBand backplane connectors does not have means for driving the insulative module having the high-speed contacts to pivotably move toward the InfiniBand board or the driving means is not durable enough, so the normal force between the high-speed contacts and the InfiniBand board may be deficient, thereby affecting signal transmission between the InfiniBand connector and the InfiniBand board. Hence, an improved InfiniBand connector is desired.

SUMMARY OF THE INVENTION

An object of the present invention is to provide a backplane connector having a unique actuator for ensuring electrical connection between contacts of the connector and solder pads on an inserted daughter board.

To obtain the above mentioned object, an electrical connector includes an insulative housing having a slot, a row of low-speed signal contacts and an insert module received in respective opposite sides of the slot. The insert module has two rows of high-speed signal contact modules confronting the row of low-speed signal contacts. The insert module is pivotable in the slot from a first position, where the connector is ready for receipt of a daughter board, to a second position, where the insert module and the row of low-speed contacts sandwich the daughter board therebetween. The electrical connector provides a pair of actuators pivotably located at the top of the insulative housing. In the second position, the actuators abut against the back portion of the insert module to pivot toward the daughter board, thereby ensuring electrical connection between the high-speed contacts in the insert module and the solder pads on the daughter board.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
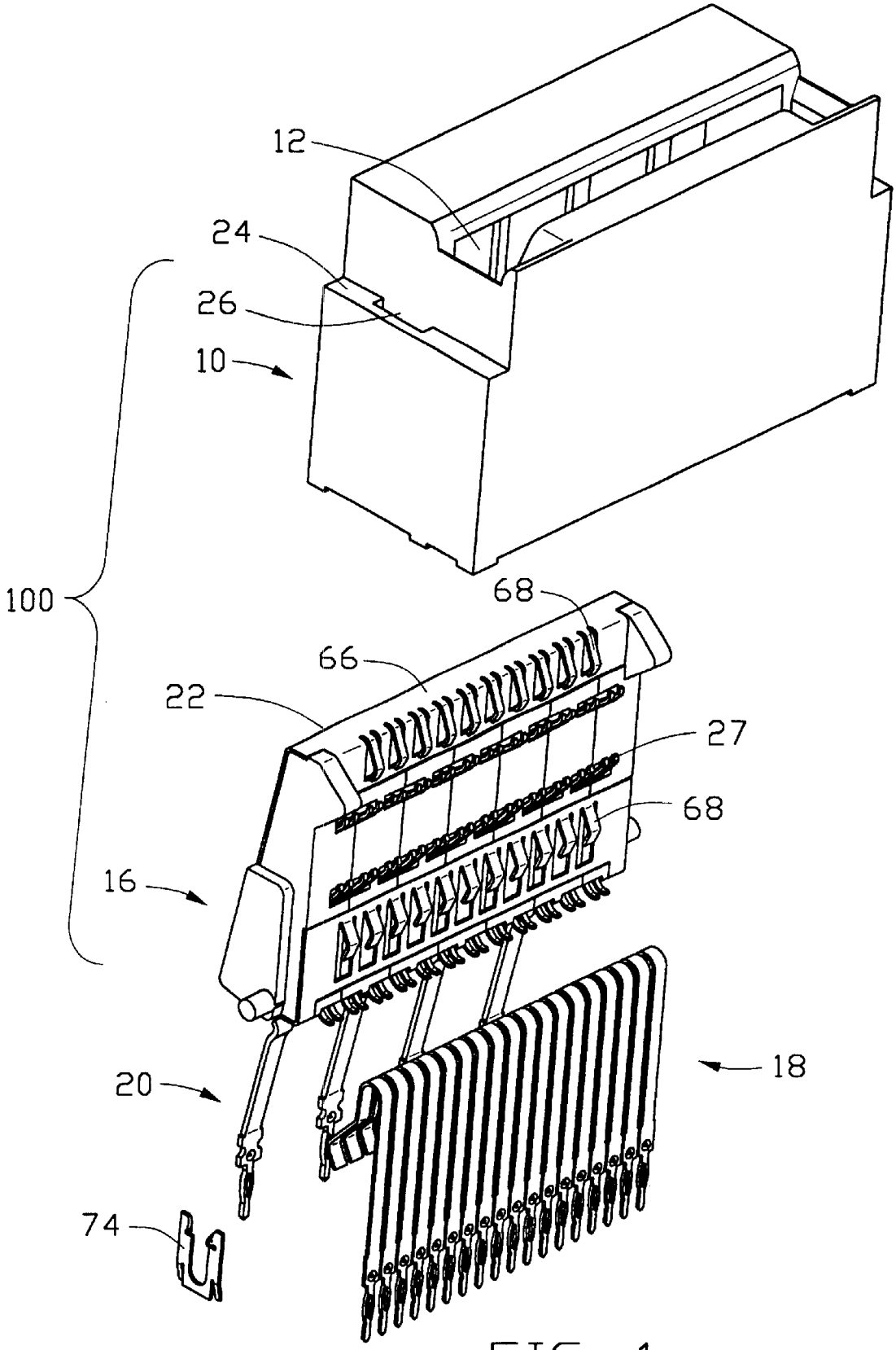
FIG. 1 is an exploded perspective view of an electrical connector according to the present invention as seen from a right-top perspective.
Figure 2:
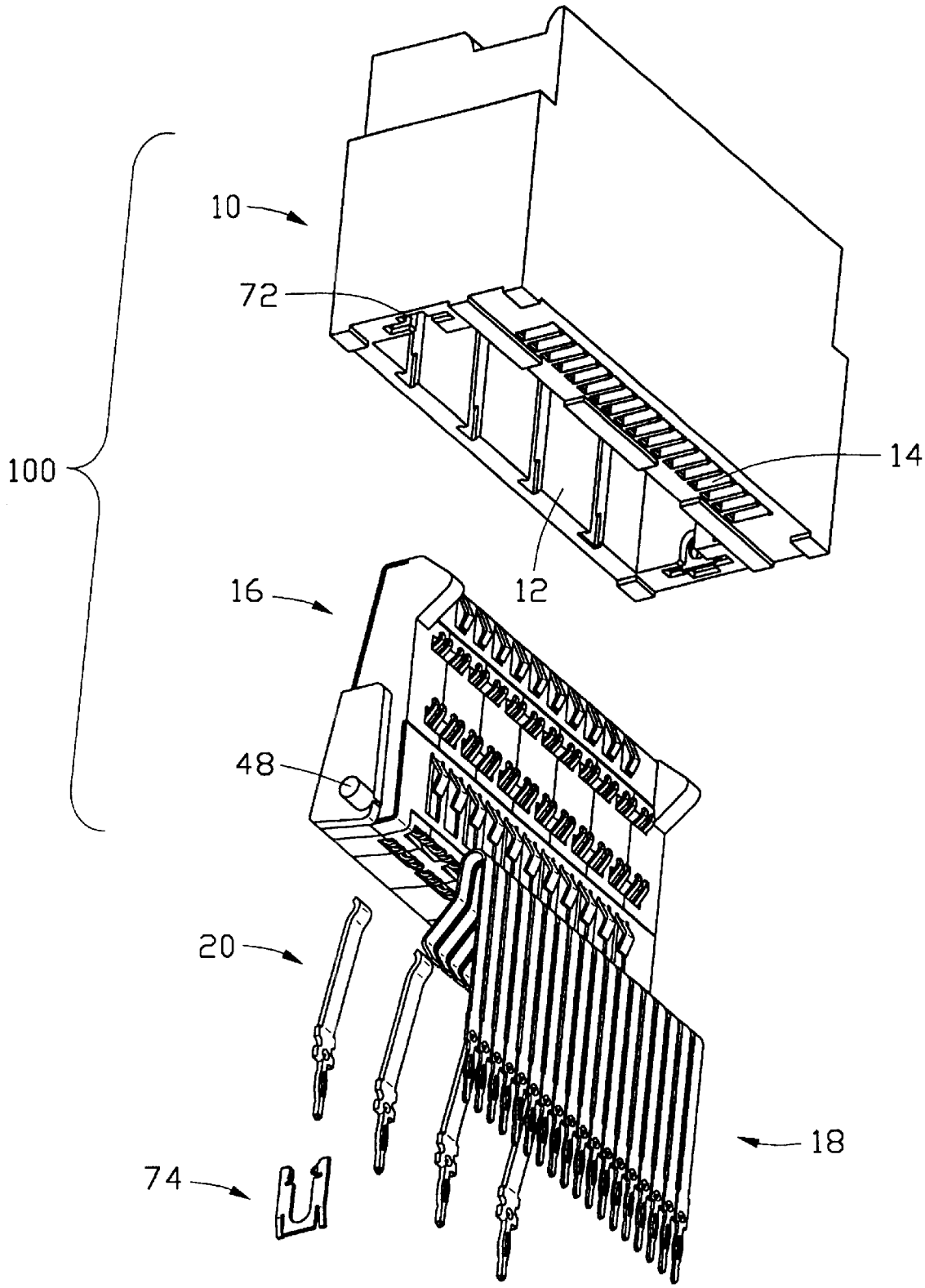
FIG. 2 is a view similar to FIG. 1 but seen from a right-bottom perspective.

Referring to the drawings in great detail, and first to FIGS. 1 and 2, an electrical connector 100 includes an insulative housing 10 defining a slot 12 and a number of cavities 14 through top to bottom thereof, an insert module 16 moveably received in the slot 12, a number of first signal contacts 18, generally low-speed signal contacts, retained in the respective cavities 14 and a number of, for example four, spring terminals 20, generally grounding contacts, located behind the insert module 16 for pressing a top portion 22 of the insert module 16 toward the first signal terminals 18. The insert module 16, the first signal contacts 18 and the spring terminals 20 are inserted in the slot 12 of the housing 10 from the bottom of the housing 10. The housing 10 has preferably a shoulder 24, defining a slit 26, at each of opposite lateral ends thereof. The shoulders 24 are engageable with fasteners or latching means (not shown) fastened to a printed circuit board (PCB) 30 (FIG. 8) for retaining the electrical connector 100 to the PCB 30. Of course, the shoulders 24 and the fasteners or latching means may be omitted in certain situations. The insert module 16 may be integrally formed by insert-molding two rows of high-speed signal contacts 27 therein. In the instant invention, the insert module 16 preferably includes a number of sub-modules and a number of contact modules 40 sandwiched between the sub-modules. This will be described in detail later.

Figure 4:
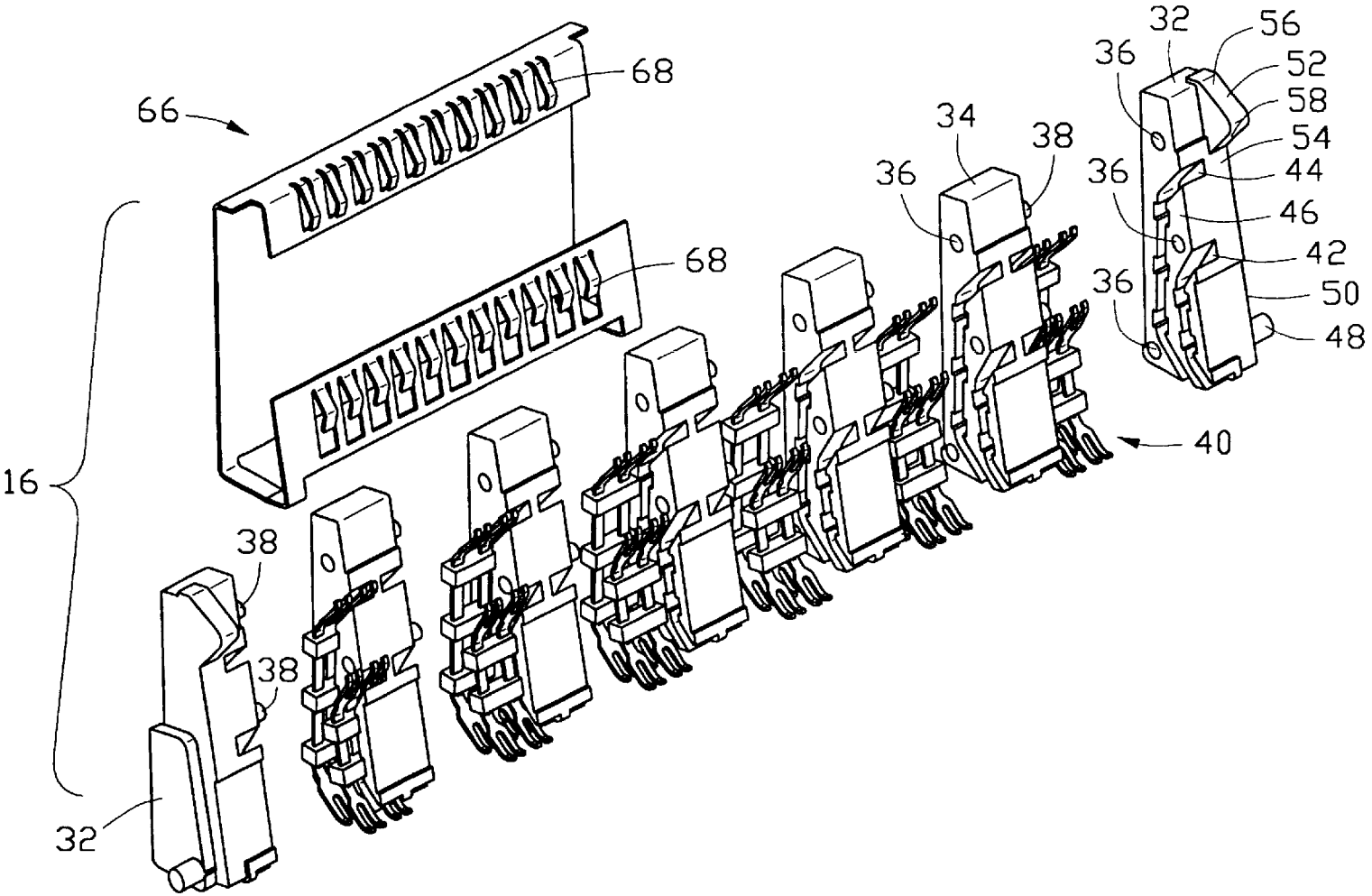
FIG. 4 is an exploded perspective view of an insert module in FIGS. 1 & 2.
Figure 5:
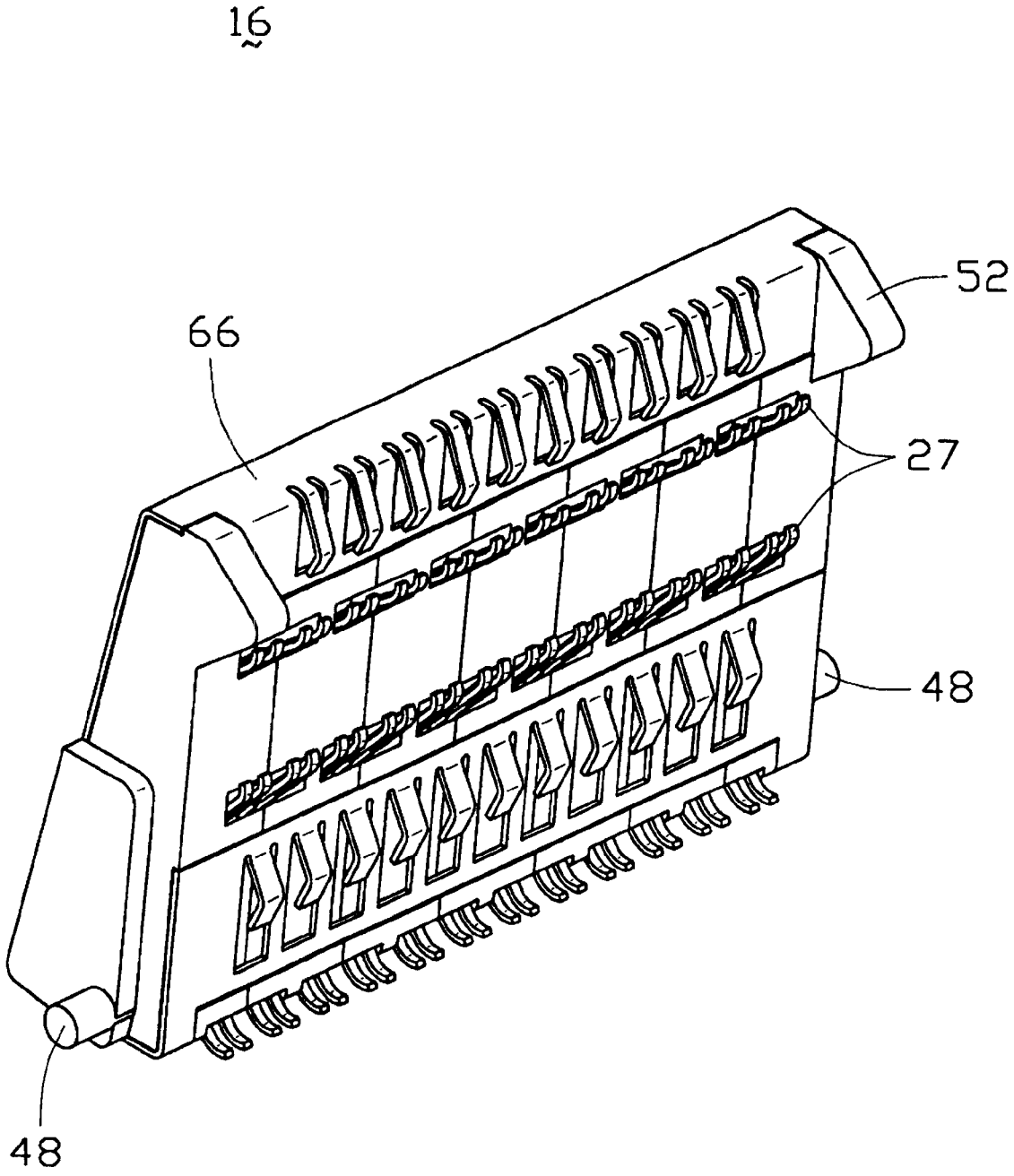
FIG. 5 is a perspective view of the assembled insert module in FIG. 4.
Figure 7:
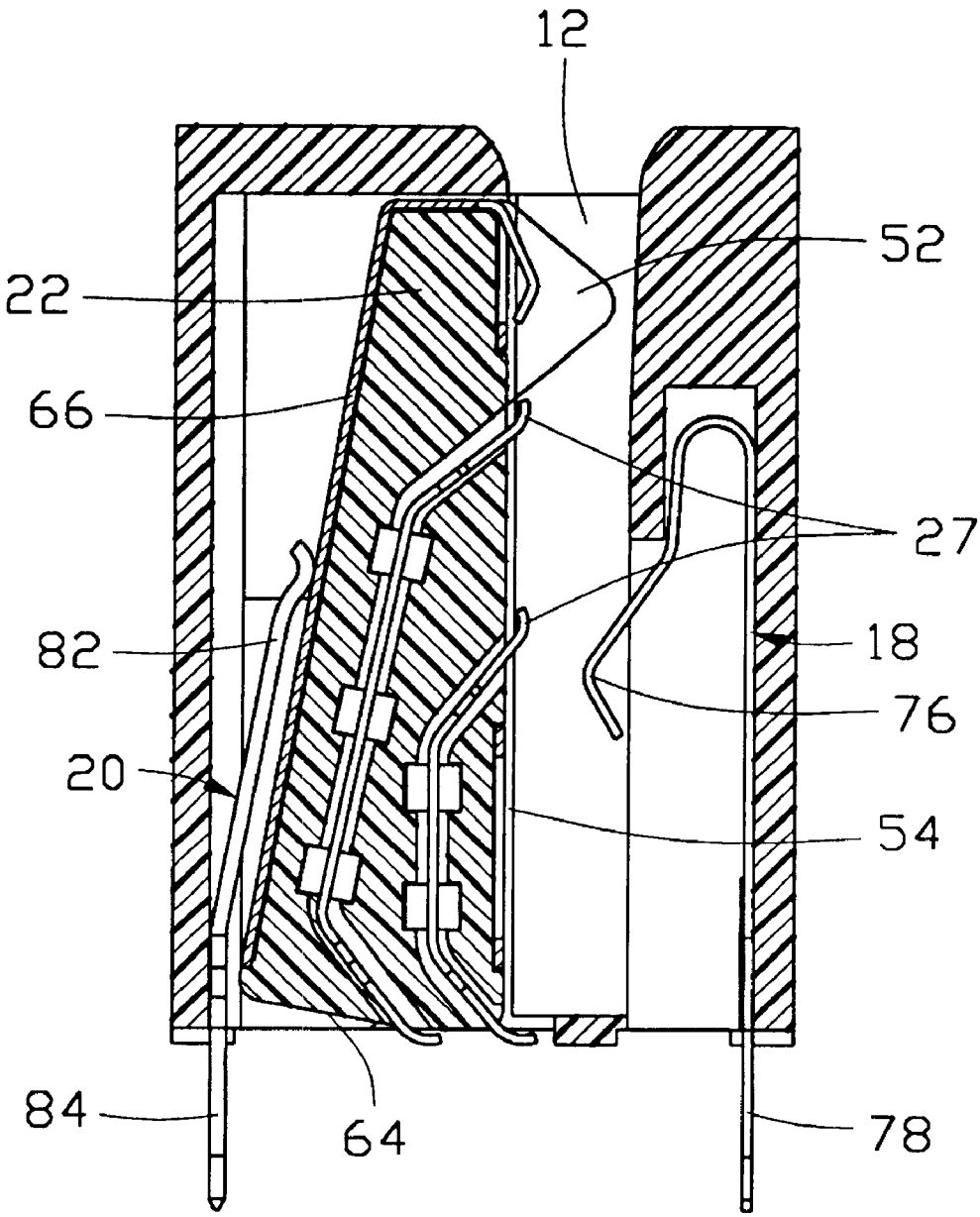
FIG. 7 is a cross-sectioned planar view of the connector in FIG. 6 taken from the cut-away end of the insulative housing.

Referring to FIG. 4, particularly, the insert module 16 includes two side modules 32, a number of middle modules 34 engaging with each other and sandwiched between the two side modules 32 via openings 36 and posts 38 in opposite side faces thereof. Each side module 32 defines a first channel 42 and a second channel 44 in an inner side face 46 thereof and has a pivot 48 on an opposite outer side face 50 thereof. Each side module 32 has a protrusion 52 in a top portion of an inner face 54 thereof. The protrusion 52 has an upper inclined surface 56 and a lower inclined surface 58. Each middle module 34 defines a first channel 42 and a second channel 44 in opposite side faces thereof. Each contact module 40 has four contacts, generally high-speed signal contacts, combined by insulations insert-molded thereto. The two rows of contact modules 40 are respectively fixedly received in the first channels 42 and the second channels 44 of the side modules 32 and the middle modules 34 with ends of the high-speed signal contacts 27 respectively extending beyond the inner face 54 and a bottom face 64 of the side and middle modules 32, 34 (FIG. 7). A metal shield 66 is applied to and wraps around the assembly of the sub-modules and the contact modules 40. The metal shield 66 has a number of spring tabs 68 attaching to grounding trails on a daughter board 70 (FIG. 9) to establish grounding path. FIG. 5 shows the completely assembled insert module 16.

Figure 3:
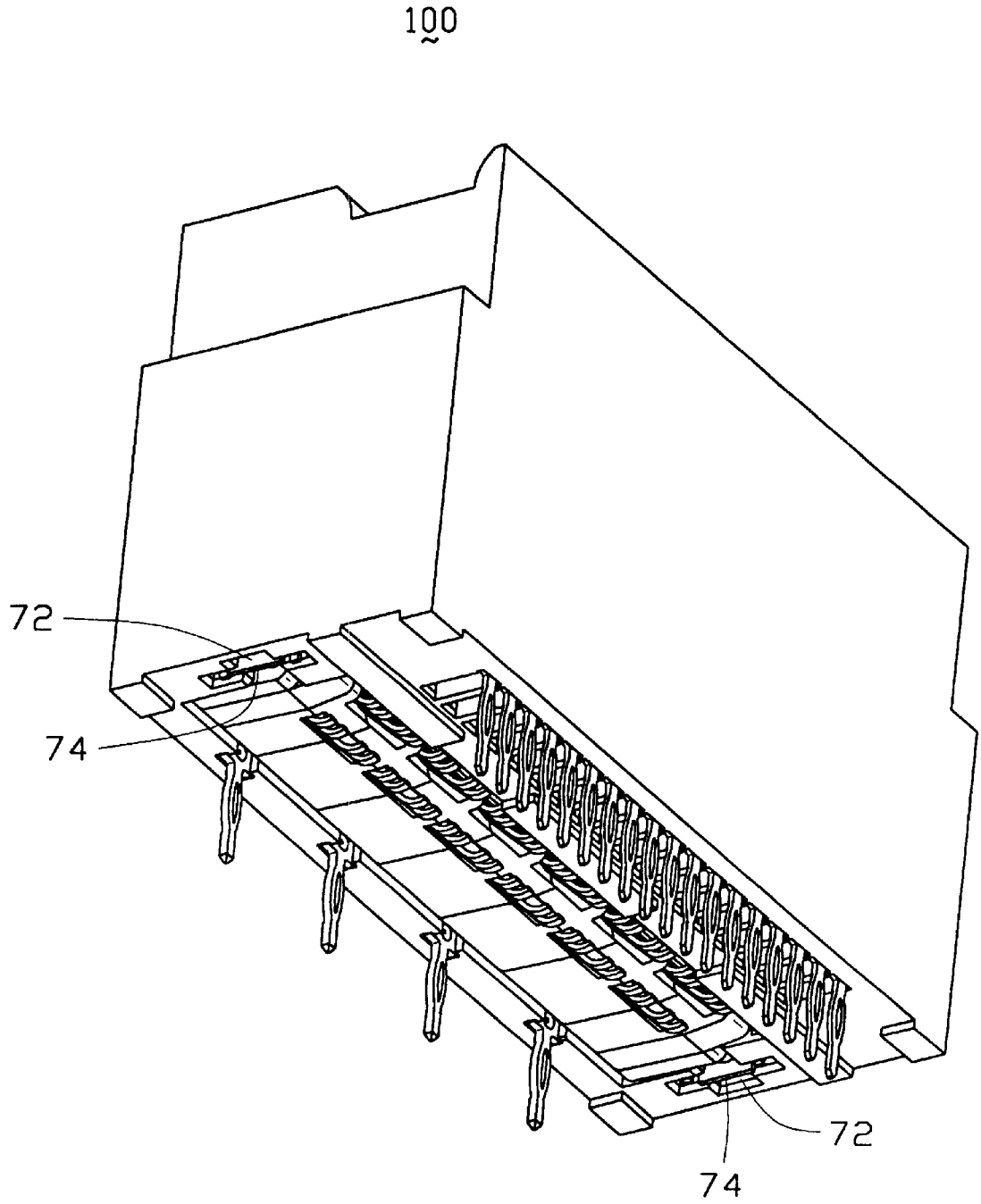
FIG. 3 is an assembled view of the electrical connector in FIG. 2.
Figure 6:
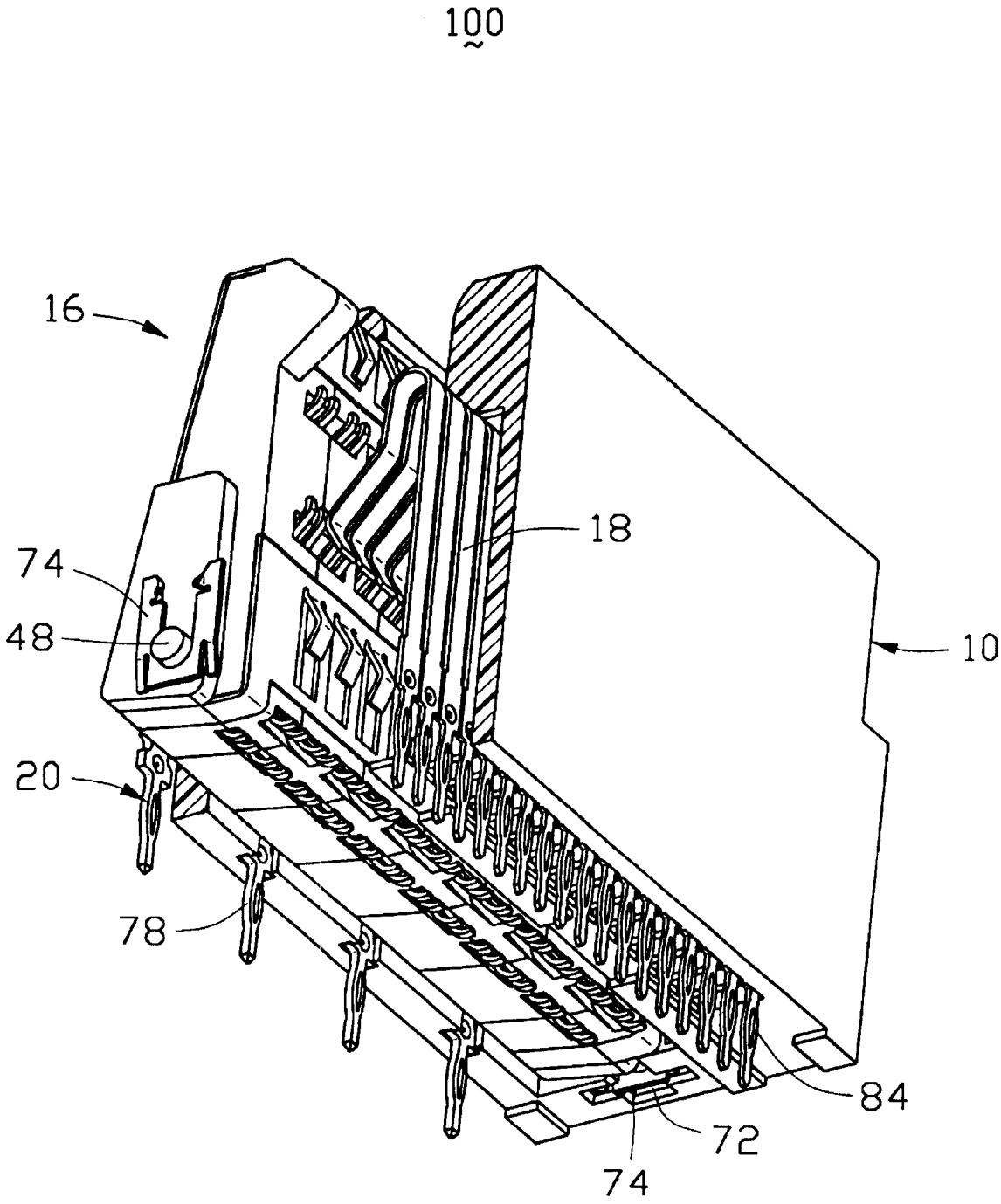
FIG. 6 is a view similar to FIG. 3 except that an end of an insulative housing of the connector is cut-away to clearly show the insert module and a number of low signal contacts in the insulative housing.
Figure 8:
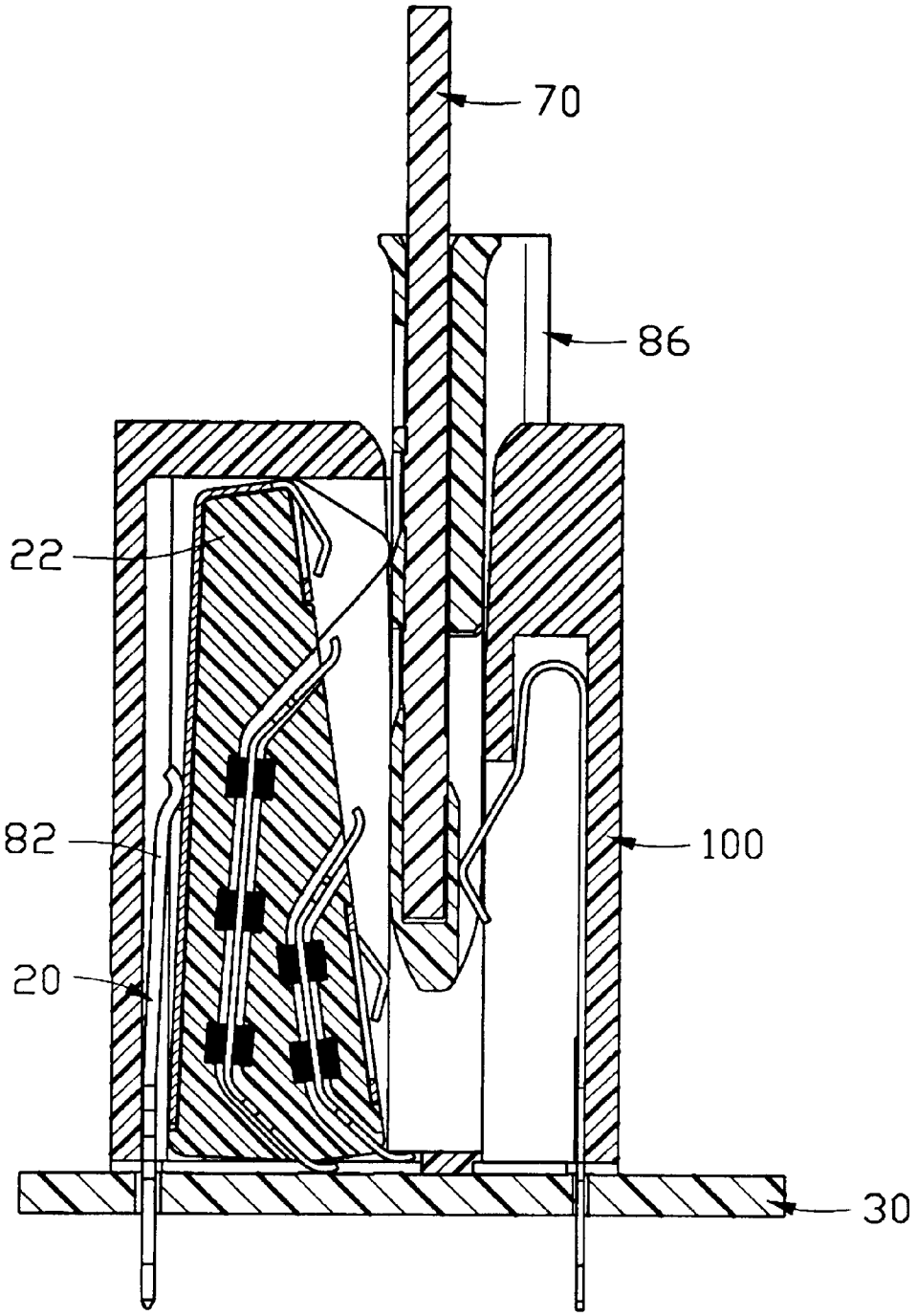
FIG. 8 is a view similar to FIG. 7 expect that an edge of an electronic device is inserted in a slot of the connector at a three-quarters depth of the slot.

Referring to FIGS. 6 and 7, the insert module 16 is rotatably received in the slot 12 of the housing 10 and the pivots 48 of the insert module 16 are pivotably received in grooves 72 of the respective lateral walls of the housing 10 (FIGS. 2 and 3). A pair of U-shaped metal clips 74 are fixedly inserted in respective grooves 72 to hold the pivots 48 in the respective grooves 72 to prevent downward movement of the insert module 16 from the housing 10. The first signal contacts 18 each include a contact portion 76 extending into the slot 12 of the housing 10 and a press-fit foot 78 extending beyond the bottom face of the housing 10 for connection to the PCB 30 (FIG. 8). The four spring terminals 20 are positioned between the insert module 16 and a rear wall of the housing 10. Each spring terminal 20 has a spring contact arm 82 pressing against the metal shield 66 to drive the top end 22 of the insert module 16 toward the first signal contacts 18 and a press-fit tail portion 84 extending beyond the bottom face of the housing 10 for connection to the PCB 30 (FIG. 8). In this institution, the protrusions 52 of the insert module 16 protrude into the slot 12 of the housing 10.

Figure 9:
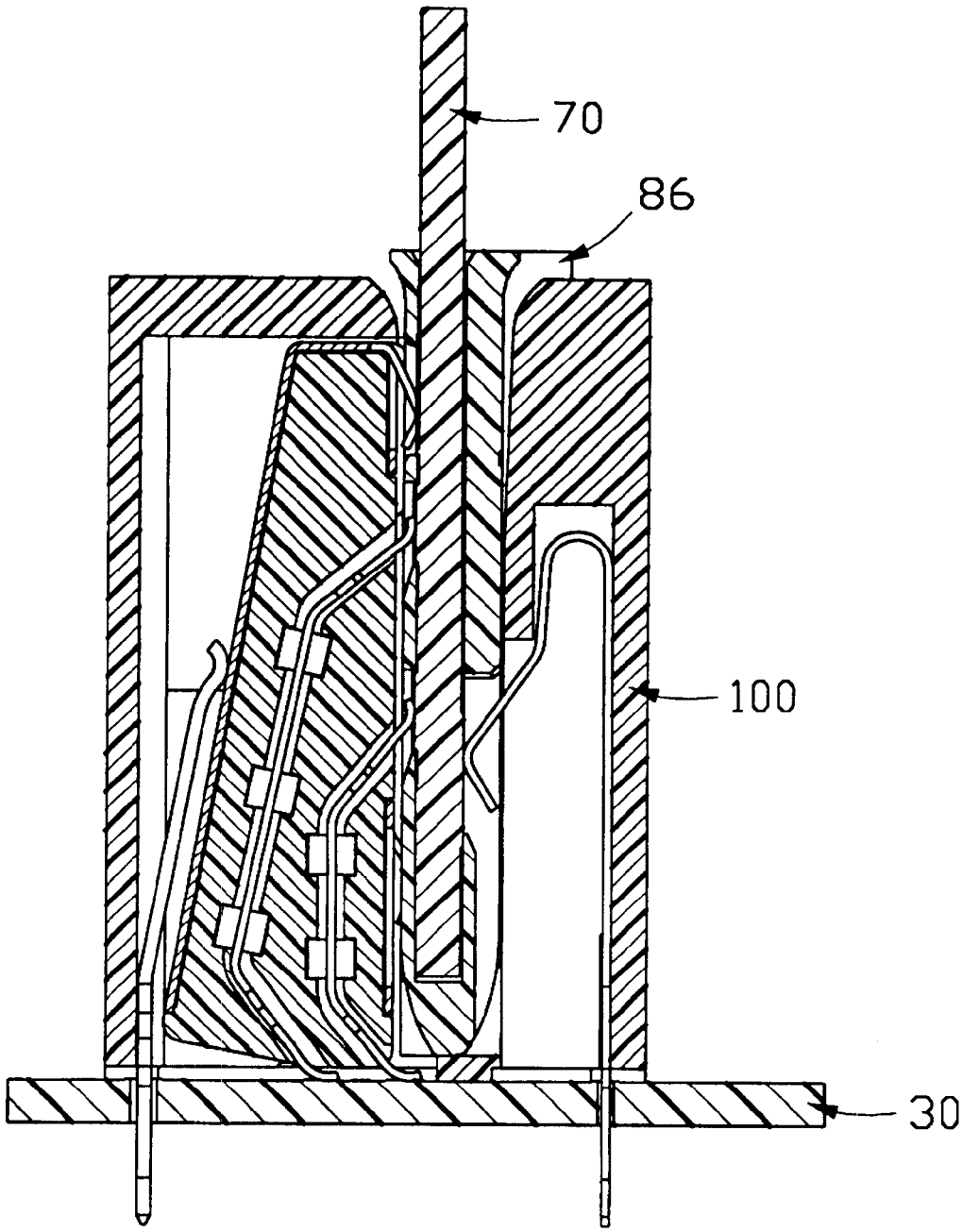
FIG. 9 is a view similar to FIG. 8 except that the electronic device is inserted in the slot of the connector at a full depth of the slot.

Referring to FIGS. 8 and 9, particularly, when the daughter board 70, shrouded by a paddle guard 86 at one edge of the daughter board 70, is inserted into the slot 12 of the housing 10 to electrically engage with the connector 100 mounted on the PCB 30, a tip of the paddle guard 86 bears against the protrusions 52 of the insert module 16 and presses the insert module 16 to rotate about the pivots 48 counterclockwise. After the daughter board 70 is adequately inserted into the slot 12, the tip of the paddle guard 86 is stopped by the bottom of the housing 10 and the protrusions 52 goes to openings of the daughter board 70 and the paddle guard 86. The insert module 16 rotates clockwise about the pivots 48 thereof under the pressure of the spring contact arms 82. The contact portions 76 of the low-speed signal contacts 18 electrically contact solder pads on the daughter board 70 and the distal ends of the high-speed contacts 27 in the insert module 16 electrically contact solder pads on an opposite surface of the daughter board 70, thereby electrically connecting the daughter board 70 the PCB board 30.

Figure 10:
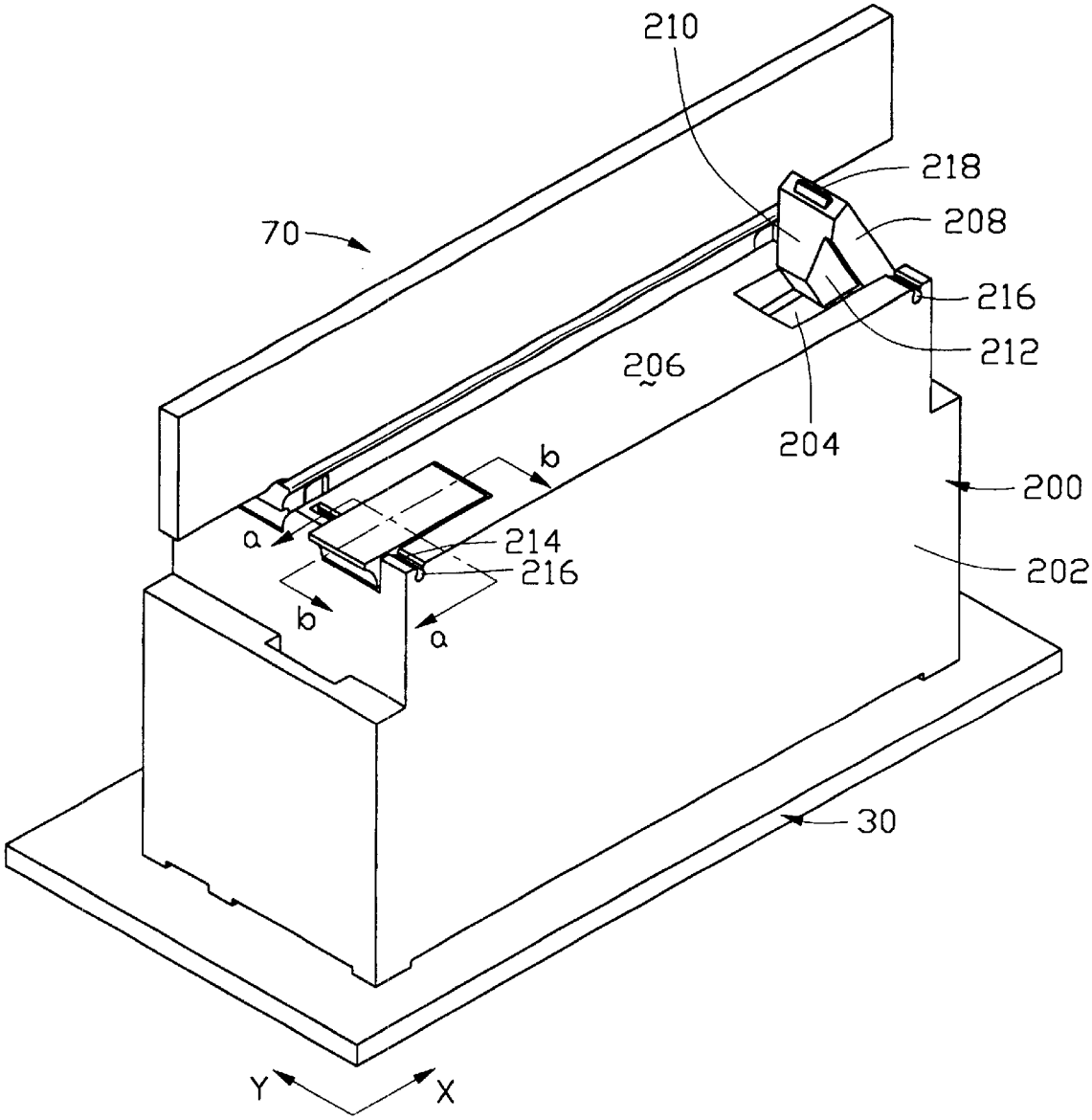
FIG. 10 is a perspective view of an electrical connector according to a second embodiment of the present invention, the connector being mounted onto a mother board and receiving an edge of the electronic device therein.
Figure 10A:
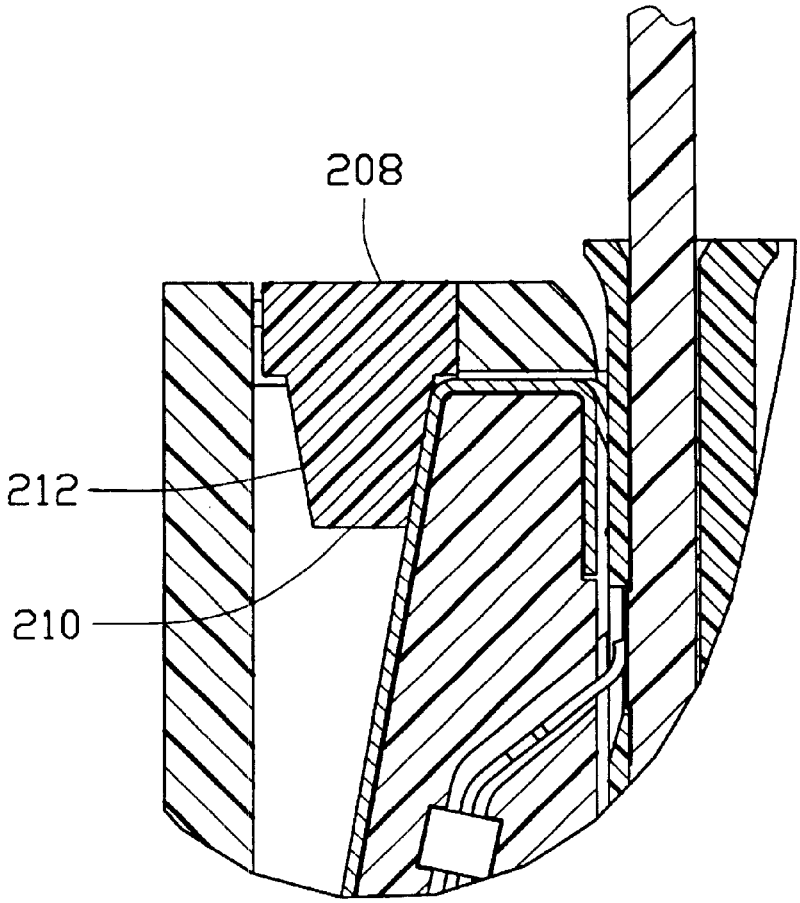
FIG. 10A is a partial, enlarged, cross-sectioned view taken along line a—a of FIG. 10.
Figure 10B:
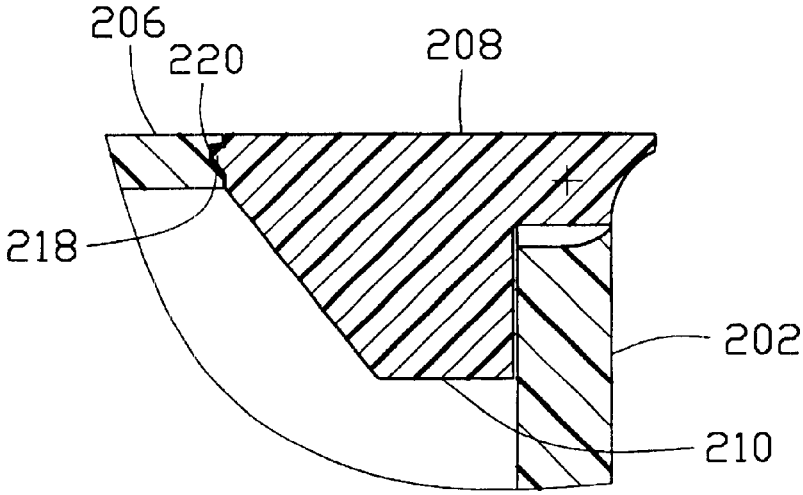
FIG. 10B is a partial, enlarged, cross-sectioned view taken along line b—b of FIG. 10.
Figure 11:
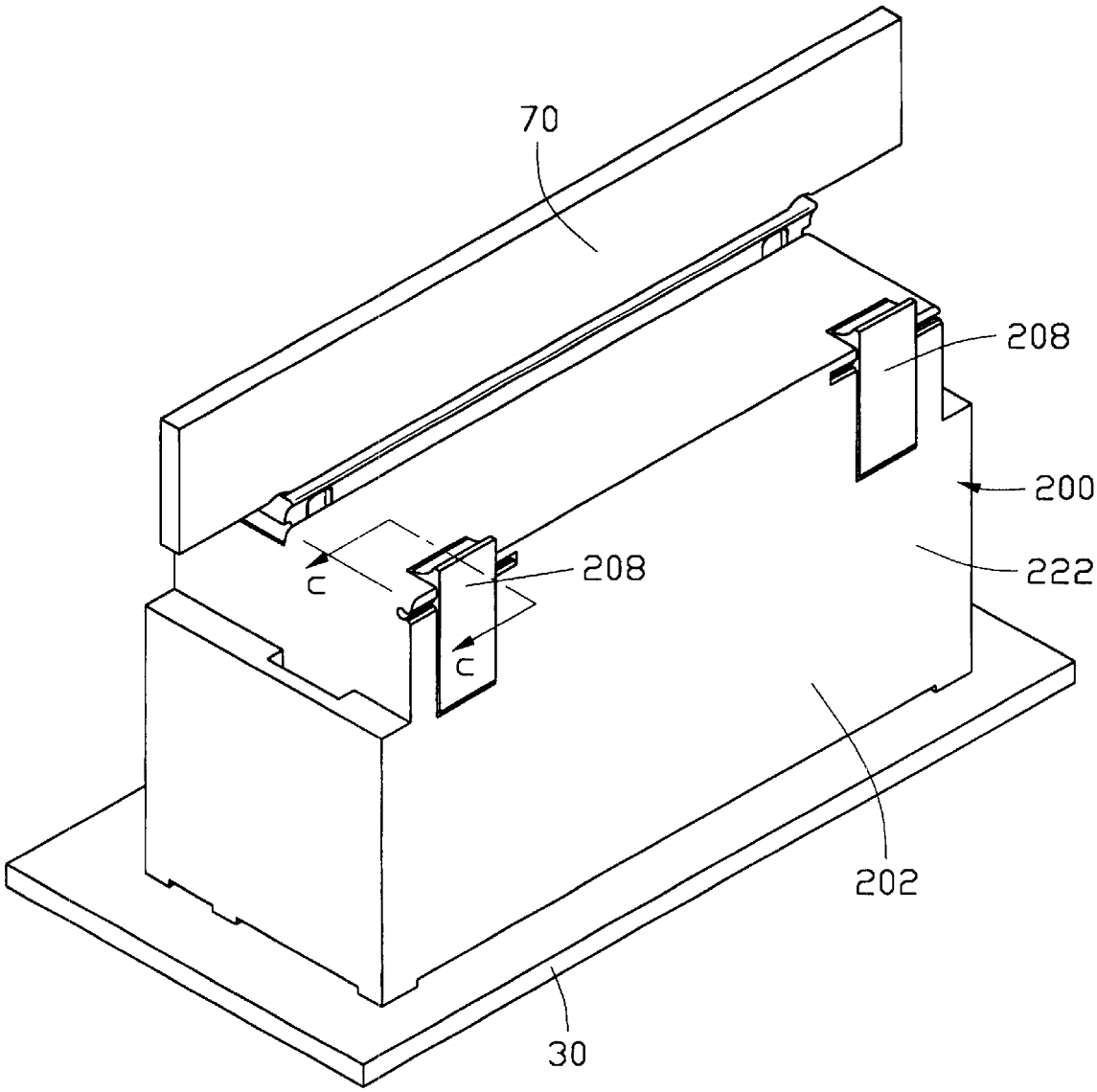
FIG. 11 illustrates a third embodiment of the present invention which is similar to FIG. 10.
Figure 12:
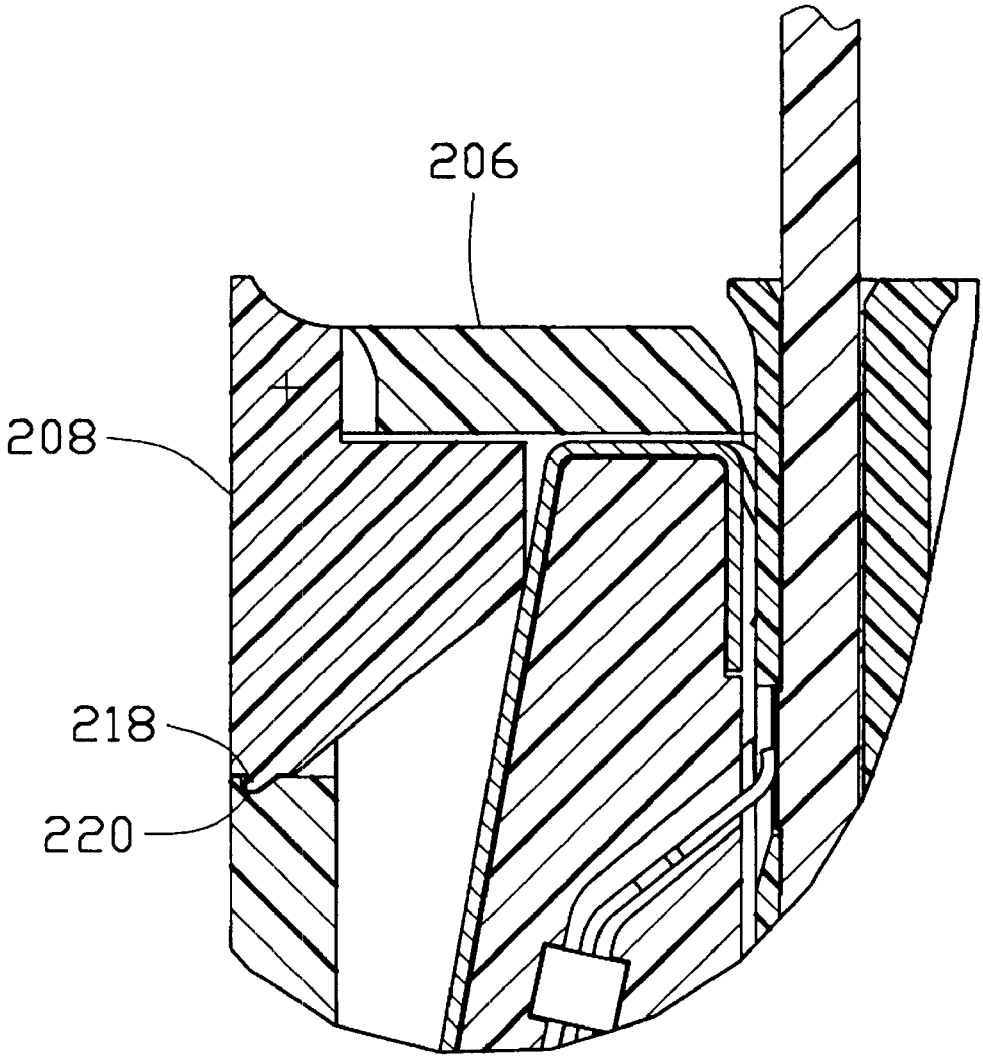
FIG. 12 is a partial, enlarged, cross-sectioned view taken along line c—c of FIG. 11.

Referring to FIGS. 10, 10A and 10B, an alternative connector 200 according to the instant invention is illustrated. The alternative connector 200 is generally the same as the connector 100 except that an insulative housing 202 thereof defines a pair of windows 204 in opposite lateral ends of a top wall 206 thereof and a pair of actuators 208 pivotably received in the respective windows 204. Each actuator 208 has a wedge-shaped portion 210 with two opposite inclined surfaces 212 and two posts 214 laterally extending beyond opposite side faces thereof. The top wall 206 defines two recesses 216 (FIG. 10B) adjacent each window 204 pivotably receiving the two posts 214 of corresponding actuator 208. Each actuator 208 has a projection 218 at a front thereof fixedly received in a respective notch 220 defined in the top wall 206 for securing the actuator 208 to the housing 202. As clearly shown in FIG. 10A, when the daughter board 70 adequately engages with the alternative connector 200, one of the inclined surfaces 212 of the actuator bears against a rear section of the top portion 22 of the insert module 16 thereby stopping counterclockwise rotation of the insert module 16. Therefore, adequate normal forces between the contact ends of the high-speed signal contacts and the solder pads of the daughter board 70 are achieved. Alternatively, the pair of actuators 208 can be located in a front wall 222 of the housing 202, which is clearly shown in FIGS. 11 and 12. It should be noted that, if required, the actuators 208 have function of rotating the insert module 16 clockwise by abutment of the wedge-shaped portion 210 against the rear section of the top portion 22 of the insert module 16.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for electrically connecting a daughter board to a mother board comprising:

an insulative housing having a front wall, a back wall, two opposite side walls and a slot defined by all the walls, the slot being defined through the top and bottom of the housing;

a plurality of first contacts fixedly retained to the front wall, each first contact having a contact portion adapted for electrically contacting the daughter board;

an insert module pivotably received in the slot of the housing, the insert module having two sub-modules arranged side by side in a direction extending from one of the two opposite side walls to the other side wall and a contact module sandwiched between the sub-modules, the contact module having a plurality of second contacts each having a contact portion adapted for electrically contacting the daughter board;

two actuators pivotably assembled to opposite side ends of the top or front wall of the housing and urging the insert module to prevent the contact portions of the second contacts from disconnecting from the daughter board;

wherein each actuator has an inclined surface or wedge-shaped portion abutting against a back portion of the insert module;

wherein each actuator has a projection on a tip thereof fixedly received in a notch defined in the housing;

further comprising a metal shield shrouding the insert module, the metal shield having a plurality of spring tabs electrically contacting the daughter board;

further comprising a plurality of grounding contacts behind the insert module which electrically contact the metal shield and are mounted to the mother board;

wherein each sub-module has a channel in a side face thereof, the contact module being sandwiched and received in the channels of the sub-modules.

* * * * *